US010375487B2

(12) United States Patent
Woods et al.

(10) Patent No.: US 10,375,487 B2
(45) Date of Patent: Aug. 6, 2019

(54) METHOD AND DEVICE FOR FILTERING SIGNALS TO MATCH PREFERRED SPEECH LEVELS

(71) Applicant: Starkey Laboratories, Inc., Eden Prairie, MN (US)

(72) Inventors: William S. Woods, Berkeley, CA (US); Tarun Pruthi, Fremont, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 408 days.

(21) Appl. No.: 15/239,088

(22) Filed: Aug. 17, 2016

(65) Prior Publication Data

US 2018/0054681 A1 Feb. 22, 2018

(51) Int. Cl.
*H04R 1/10* (2006.01)
*H04R 25/00* (2006.01)

(52) U.S. Cl.
CPC ..... *H04R 25/43* (2013.01); *H04R 1/1083* (2013.01); *H04R 25/55* (2013.01); *H04R 2225/43* (2013.01)

(58) Field of Classification Search
CPC ..... H04R 25/43; H04R 1/1083; H04R 25/55; H04R 2225/43
USPC ..... 381/317
See application file for complete search history.

(56) References Cited

U.S. PATENT DOCUMENTS 7,983,720 B2 7/2011 Chen
8,219,387 B2 7/2012 Cutler et al.
8,386,247 B2 2/2013 Yang et al.
8,423,360 B2 4/2013 Koshiba et al.
8,428,661 B2 4/2013 Chen
8,433,061 B2 4/2013 Cutler
8,509,703 B2 8/2013 Chen et al.
8,744,069 B2 6/2014 Cutler
8,868,417 B2 10/2014 Konchitsky et al.
8,868,418 B2 10/2014 Konchitsky et al.
8,948,416 B2 2/2015 Chen et al.
2002/0057808 A1* 5/2002 Goldstein ..... H04R 25/356 381/106
2002/0080979 A1* 6/2002 Brimhall ..... A61F 11/08 381/72
2002/0172350 A1 11/2002 Edwards et al.
2005/0010406 A1 1/2005 Koshiba et al.
2010/0119077 A1* 5/2010 Platz ..... A61F 11/08 381/72

(Continued)

FOREIGN PATENT DOCUMENTS

WO WO-2009049320 A1 4/2009

OTHER PUBLICATIONS

Brouckxon, H., et al., "Time and Frequency Dependent Amplification for Speech Intelligibility Enchancement in Noisy Environments", Proc. Interspeech, (2008), 557-560.

(Continued)

*Primary Examiner* — Sean H Nguyen
(74) *Attorney, Agent, or Firm* — Schwegman Lundberg & Woessner, P.A.

(57) ABSTRACT

Described herein are methods and devices for mixing input signals from multiple audio input sources in a hearing device such as a hearing aid. In one embodiment, a gain is applied to a telecoil signal where the gain is computed so as to depend on the level of a microphone signal. The technique does not depend on the user's audiogram and allows control of the gain for all environments with one adjustment.

18 Claims, 2 Drawing Sheets

(56) References Cited

U.S. PATENT DOCUMENTS

| | | | | |
|---|---|---|---|---|
| 2011/0066427 | A1 | 3/2011 | Konchitsky et al. | |
| 2011/0071821 | A1 | 3/2011 | Konchitsky et al. | |
| 2012/0008807 | A1* | 1/2012 | Gran | H04R 25/407 381/313 |
| 2012/0016669 | A1 | 1/2012 | Endo et al. | |
| 2012/0063610 | A1* | 3/2012 | Kaulberg | H04R 25/407 381/71.1 |
| 2012/0239385 | A1* | 9/2012 | Hersbach | G10L 25/84 704/200.1 |
| 2012/0259625 | A1 | 10/2012 | Yang et al. | |
| 2014/0003640 | A1 | 1/2014 | Puria et al. | |
| 2014/0044291 | A1* | 2/2014 | Xia | H04R 25/50 381/321 |
| 2015/0181355 | A1* | 6/2015 | Pedersen | H04R 25/407 381/313 |

OTHER PUBLICATIONS

Recker, Karrie L, "The Effect of Presentation Level on Normal-Hearing and Hearing-Impaired Listeners Acceptable Speech and Noise Levels", J Am Acad Audiol 24, (2013), 17-25.

Sauert, B., et al., "Near-End Listening Enhancement in the Presence of Bandpass Noises", Proceedings of Speech Communication; 10. ITG Symposium, (2012), 1-4.

Taal, C. H, et al., "On Optimal Linear Filtering of Speech for Near-End Listening Enhancement", IEEE Signal Processing Letters, 20(3), (2013), 225-228.

Yoo, S. D, et al., "Speech signal modification to increase intelligibility in noisy environments", J Acoust Soc Am., 122(2), (Aug. 2007), 1138-49.

* cited by examiner

METHOD AND DEVICE FOR FILTERING SIGNALS TO MATCH PREFERRED SPEECH LEVELS

FIELD OF THE INVENTION

This invention pertains to electronic hearing aids and methods for their use.

BACKGROUND

Hearing assistance devices such as hearing aids are electronic instruments that compensate for hearing losses by amplifying sound. The electronic components of a hearing assistance device typically include a microphone for receiving ambient sound, an amplifier for amplifying the microphone signal in a manner that depends upon the frequency and amplitude of the microphone signal, a speaker for converting the amplified microphone signal to sound for the wearer, and a battery for powering the components.

Hearing assistance devices may also incorporate audio source components besides a microphone. For example, in addition to a microphone, a hearing assistance device could include a telecoil, a wireless receiver, a direct audio input interface, and/or one more additional microphones. The manner in which the hearing assistance device processes and mixes signals from multiple audio source components is a primary concern of the present disclosure.

DETAILED DESCRIPTION

Figure 1:
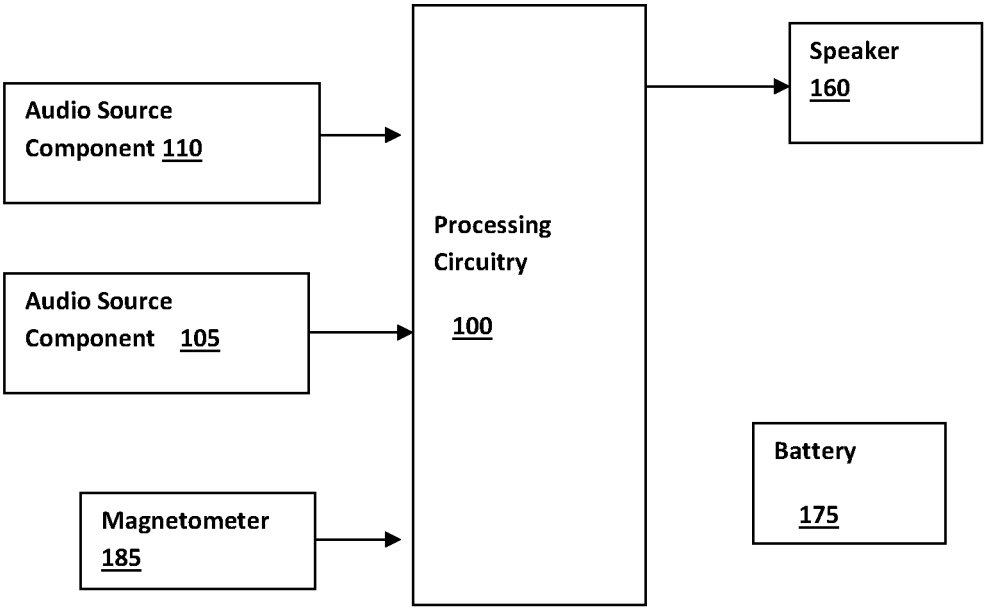
FIG. 1 shows the basic electronic components of an example hearing aid according to some embodiments.

FIG. 1 illustrates the basic functional components of an example hearing assistance device. In an embodiment where the hearing assistance device is a hearing aid, the electronic circuitry of the hearing aid is contained within a housing that may be placed, for example, in the external ear canal or behind the ear. The hearing assistance device in FIG. 1 is equipped with a first audio source component 105 and a second audio source component 110. In one embodiment, the second audio source component 110 is a microphone, and the first audio source component 110 is a telecoil, a wireless receiver, a direct audio input interface, or an additional microphone. The first audio source component 105 produces a first input signal, while the microphone audio source component 110 receives sound waves from the environment and converts the sound into a second input signal. The device's processing circuitry 100 mixes and processes the digitized first and second input signals into an output signal in a manner that compensates for the patient's hearing deficit. The processing circuity may include analog amplifiers, analog-to-digital converters, and digital-to-analog converters for converting the input signal to an output signal. The output signal drives the receiver or speaker 160 to convert the output signal into an audio output. A battery 175 supplies power for the electronic components.

The processing circuitry 100 may be implemented in a variety of different ways, such as with an integrated digital signal processor or with a mixture of discrete analog and digital components. For example, the signal processing may be performed by a mixture of analog and digital components having inputs that are controllable by the controller that define how the input signal is processed, or the signal processing functions may be implemented solely as code executed by the controller. The terms "controller," "module," or "circuitry" as used herein should therefore be taken to encompass either discrete circuit elements or a processor executing programmed instructions contained in a processor-readable storage medium.

In various embodiments, the hearing assistance device as illustrated in FIG. 1 may be equipped with any combination of microphones, telecoils, wireless receivers, or direct audio input interfaces as the first and second audio source components. In various embodiments, the hearing assistance device may be operated in a mode in which only one of the first or second audio source components is active or in a mode in which both audio source components are active. In the latter case, the processing circuitry 100 may mix and process the first and second input signals in accordance with the algorithms described below.

In one embodiment, the first audio source component 105 in FIG. 1 is a telecoil, while the second audio source component is a microphone. A telecoil (also referred to as a T-coil for "telephone coil") is a small device installed in a hearing aid assistance device that detects the electromagnetic field generated by audio induction loops such as the speaker of a telephone handset. The signal from the telecoil is digitized and fed to the processing circuitry 100 where it is mixed with the microphone signal to generate the audio output for the hearing aid wearer when the hearing aid is operating in a telecoil mode. The telecoil mode may be activated manually via a user input or may be activated automatically when the presence of a magnetic field produced by the magnet of a telephone speaker is sensed. For this purpose, a magnetometer 185 for detecting the magnitude of a magnetic field may be connected to the processing circuitry 100 as shown in FIG. 1.

In one embodiment, the first audio source component 105 is a wireless receiver for wirelessly receiving audio signals from an external source such as over a network. For example, a network connected device such as a smart phone or computer may stream programs received over the internet to the hearing device via the wireless receiver. In various embodiments, the wireless receiver may operate in the 900 MHz, 2.4 GHz, or 5 GHz bands and in accordance with standards such as Wi-Fi or Bluetooth. In another embodiment, the first audio source component is a direct audio input (DAI) interface for receiving audio signals via a wired connection with an external device such as a smart phone, computer, or audio player.

In one embodiment, the first audio source component comprises one or more additional microphones in addition to a primary microphone as the second audio source component. For example, the first audio source component microphone may be a directional microphone while the second audio source component microphone may be an omnidirectional microphone. The directional microphone in one example could be configured to more sensitively detect sounds directly in front of a hearing aid wearer.

Described below are techniques by which a hearing device such as illustrated by FIG. 1 may mix and process the first and second input signals as generated by the first and second audio source components, respectively. Typically, one of the input signals is of primary interest to the device wearer while the other input signal is of only secondary interest and used to environmental maintain awareness. For example, in the case where the first input signal is generated by a telecoil and the second input signal is generated by a microphone, a device wearer listening to a phone call may still want to hear sounds picked up by the microphone in order to maintain awareness of his/her surroundings. The same applies when the first audio source component is a wireless receiver or a DAI interface. Similarly, in the case where the first audio source component is a forward-directed directional microphone and the second audio source component is an omni-directional microphone, the former is of primary interest while the latter supplies environmental awareness.

In any of the situations described above, a useful metric for optimizing a user's listening experience is a signal-to-noise ratio (SNR) where the first input signal is regarded as signal and the second input signal is regarded as noise. If for example, the second input signal were to increase (e.g., due to increased noise in the environment), the SNR would be adversely affected unless gain is applied to the first input signal. Merely providing for the capability of manual adjustment of the gain on the part of the device user is not only inconvenient, but also problematic because a user may not be able to quickly determine the optimal amount of gain that should be applied to provide both audibility and comfort. Described herein are methods and apparatus to automatically provide the gain modifications to the first input signal and to allow the user to tune the amount of gain applied for different environments with one adjustment.

Figure 2:
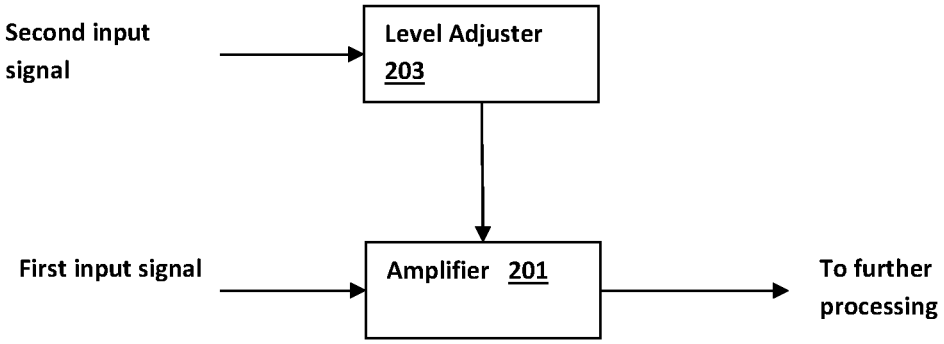
FIG. 2 shows components for applying gain to an audio source component signal according to some embodiments.

In one embodiment, gain is applied to one or both of the first and second input signals in order to achieve an optimal SNR for the listener where the optimal SNR is made to depend upon a measured level of the second input signal regarded as noise. FIG. 2 shows the processing components for applying gain to the first input signal according to one embodiment. These components may be implemented by the processing circuitry in either the analog or digital domain. The first signal from the first audio source component is passed to an amplifier 201 whose gain is controlled by level adjuster 203. The level adjuster 203 receives the second input signal from the second audio source component and computes the gain applied to the amplifier 201 in a manner dependent upon the level of the second input signal. In some embodiments, these components are implemented in the digital domain by digital processing circuitry and may be performed separately for multiple frequency bands according to a user's individual hearing deficit (e.g., as reflected by the user's audiogram).

Previous approaches to the problem of how to best process speech signals in order to optimize speech intelligibility have included looking for important speech features, such as formants or transients, and attempting to amplify or otherwise enhance those features. Other approaches have tried to maximize the speech intelligibility index (SII) while keeping the overall speech level constant. These methods assume listeners prefer to maximize their speech intelligibility while listening to the phone signal, which may not be true. Another previous approach determines gain based on common hearing-aid gain targets or on masking levels. This approach requires knowledge of the user's audiogram, however, which may not be available.

Figure 3:
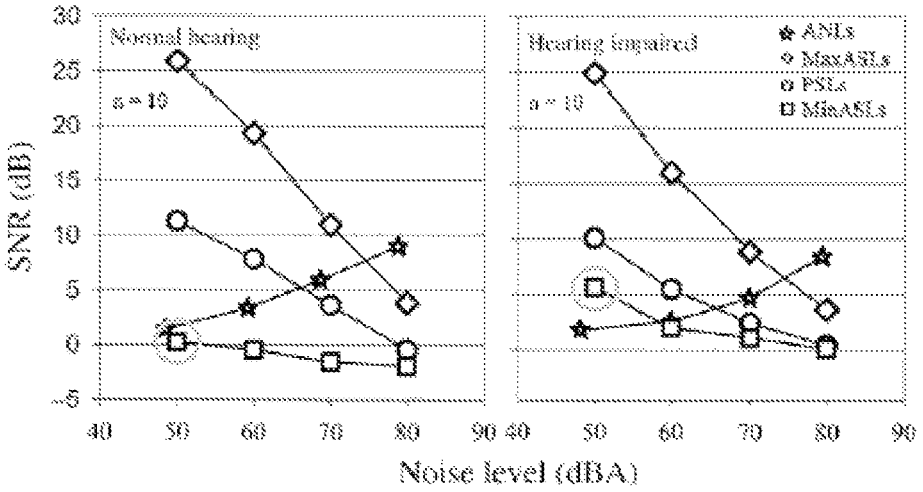
FIG. 3 illustrates the relationship between preferred signal-to-noise ratios and noise level for normal and hearing impaired subjects according to some embodiments.

It has been demonstrated that the relationship between preferred speech levels (PSLs) expressed as a preferred SNR and the level of accompanying noise is similar among individuals whether or not hearing impaired (See Recker, K.,& Edwards, B., "The effect of presentation level on normal-hearing and hearing-impaired listeners' acceptable speech and noise levels," J Am Acad Audiol 24, 17-25 (2013)). An example of such data is shown in FIG. 3, where preferred speech levels (PSLs) expressed as SNR in dB SPL were determined by normal and hearing impaired listeners. The listeners indicated their preferred listening level for speech as a function of background noise level. The hearing impaired (HI) listeners wore hearing aids for the test. It is seen in the figure that the preferred SNR changes with background level, indicating that listeners do not maintain a constant SII. It was also found that there is no statistically significant difference between PSLs across normal and impaired-hearing groups. This is consistent with the hypothesis that the PSL does not change across different HI listeners if they are using well-fitted hearing aids, and thus one does not need to know the audiogram to set the speech signal gain in this condition.

In one embodiment, a gain is applied to the first input signal in a hearing device such as illustrated in FIG. 1 that results in an SNR that is likely to be preferred by the listener, where the first input signal is regarded as signal and the second input signal is regarded as noise. For example, in the context of telecoil and microphone combination where the first audio source component is a telecoil and the second audio source component is a microphone, the SNR is the ratio of the phone or telecoil signal to the microphone or near-end signal, the latter being regarded as noise interfering with the speech contained in the phone signal. In one embodiment, a hearing aid is configured to apply a gain to the first input signal with the gain value G applied being computed as:

$$G=SNR_{preferred}-S+N$$

where S is the measured level of the first input signal, N is the measured level of the second input signal, and $$SNR_{preferred}=m*N+b$$

where the slope m and intercept b for computing the $SNR_{preferred}$ are adjustable constants. Predefined values the slope m and intercept b may be derived from preferred speech level (PSL) data averaged across listener groups. The S, N, and $SNR_{preferred}$ values may be expressed in decibels or other logarithmic scale (i.e., so that, for example, SNR=S−N). The device may be further configured as described in the following embodiments which may be combined as desired. In one embodiment, the device is further configured to apply the gain formula as described above when the noise level exceeds 50 dB SPL. In another embodiment, the device is further configured to apply the gain formula as described above when the measured noise level is between 50 dB SPL and 80 dB SPL. In another embodiment, the device is configured to accept a user input for the intercept b used to calculate $SNR_{preferred}$ as a function of the measured noise (i.e., second input signal) level. In another embodiment, the device is configured to accept a user input for the intercept b and the slope m used to calculate $SNR_{preferred}$ as a function of the measured noise (i.e., second input signal) level. Other embodiments may use a second-order polynomial instead of first-order polynomial formula for computing the gain as a function of the second input signal level.

Example Embodiments

In Example 1, a hearing device, comprises: a first audio source component to produce a first input signal; a second audio source component to produce a second input signal; processing circuitry to process a combination of the first input signal and the second input signal into an output signal; a speaker to convert the output signal into an audio output; and, wherein the processing circuitry is further to: measure levels of the first and second input signals; derive a signal-to-noise ratio (SNR) as a ratio between the measured levels of the first and second input signals, respectively, the first input signal being regarded as signal (S) and the second input signal being regarded as noise (N); calculate a target value $SNR_{preferred}$ for the SNR, either explicitly or by using a look-up table, as a function of the measured level of the second input signal; and, apply a gain to the first input signal in a manner that attempts to maintain the SNR at the target value $SNR_{preferred}$;

In Example 2, the subject matter of any of the Examples herein may optionally include wherein the processing circuitry is further to calculate the target value $SNR_{preferred}$ as a linear function of the measured level of the second input signal.

In Example 3, the subject matter of any of the Examples herein may optionally include wherein the processing circuitry is to apply a gain G to the first input signal where:

$$G=SNR_{preferred}-S+N$$

where S is the measured level of the first input signal regarded as signal and N is the measured level of the second input signal regarded as noise.

In Example 4, the subject matter of any of the Examples herein may optionally include wherein $SNR_{preferred}$ is calculated as:

$$SNR_{preferred}=m*N+b$$

where the slope m and intercept b are adjustable values.

In Example 5, the subject matter of any of the Examples herein may optionally include wherein the processing circuitry is further to calculate the target value $SNR_{preferred}$ as a second order polynomial function of the measured level of the second input signal.

In Example 6, the subject matter of any of the Examples herein may optionally include wherein the processing circuitry is further to calculate the target value $SNR_{preferred}$ as a function of the measured level of the second input signal that decreases as the measured level of the second input signal increases.

In Example 7, the subject matter of any of the Examples herein may optionally include wherein: the first audio source component is a telecoil to convert a time-varying electromagnetic field sensed by the telecoil into the first input signal; and, wherein the second audio source component is a microphone to convert sensed sound into the second input signal.

In Example 8, the subject matter of any of the Examples herein may optionally include wherein: the first audio source component is a direct audio input (DAI) device to receive signals from an external source; and, the second audio source component is a microphone to convert sensed sound into the second input signal.

In Example 9, the subject matter of any of the Examples herein may optionally include wherein: the first audio source component is a wireless receiver to receive wireless streaming signals and generate the second input signal therefrom; and, the second audio source component is a microphone to convert sensed sound into the second input signal.

In Example 10, the subject matter of any of the Examples herein may optionally include wherein the first and second audio source components are both microphones to convert sound into the first and second input signals, respectively.

In Example 11, method for operating a hearing assistance device, comprises performing any of the functions performed by the device components in Examples 1 through 10.

In Example 12, a non-transitory computer-readable medium contains instructions for performing any of the functions performed by the processing circuitry in Examples 1 through 10.

Other Embodiments

It is understood that variations in configurations and combinations of components may be employed without departing from the scope of the present subject matter. Hearing assistance devices may typically include an enclosure or housing, a microphone, processing electronics, and a speaker or receiver. The examples set forth herein are intended to be demonstrative and not a limiting or exhaustive depiction of variations.

The present subject matter can be used for a variety of hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The subject matter has been described in conjunction with the foregoing specific embodiments. It should be appreciated that those embodiments may also be combined in any manner considered to be advantageous. Also, many alternatives, variations, and modifications will be apparent to those of ordinary skill in the art. Other such alternatives, variations, and modifications are intended to fall within the scope of the following appended claims.

What is claimed is:

1. A hearing device, comprising:

a first audio source component to produce a first input signal;

a second audio source component to produce a second input signal;

processing circuitry to process a combination of the first input signal and the second input signal into an output signal;

a speaker to convert the output signal into an audio output; and, wherein the processing circuitry is further to:

measure levels of the first and second input signals;

derive a signal-to-noise ratio (SNR) as a ratio between the measured levels of the first and second input signals, respectively, the first input signal being regarded as signal (S) and the second input signal being regarded as noise (N);

calculate a target value $SNR_{preferred}$ for the SNR, either explicitly or by using a look-up table, as a function of the measured level of the second input signal; and, apply a gain G to the first input signal in a manner that attempts to maintain the SNR at the target value $SNR_{preferred}$ where:

$$G=SNR_{preferred}-S+N$$

and where S is the measured level of the first input signal regarded as signal and N is the measured level of the second input signal regarded as noise.

2. The device of claim 1 wherein the processing circuitry is further to calculate the target value $SNR_{preferred}$ as a linear function of the measured level of the second input signal.

3. The device of claim 1 wherein $SNR_{preferred}$ is calculated as:

$$SNR_{preferred}=m*N+b$$

where the slope m and intercept b are adjustable values.

4. The device of claim 1 wherein the processing circuitry is further to calculate the target value $SNR_{preferred}$ as a second order polynomial function of the measured level of the second input signal.

5. The device of claim 1 wherein the processing circuitry is further to calculate the target value $SNR_{preferred}$ as a function of the measured level of the second input signal that decreases as the measured level of the second input signal increases.

6. The device of claim 1 wherein:

the first audio source component is a telecoil to convert a time-varying electromagnetic field sensed by the telecoil into the first input signal; and, wherein the second audio source component is a microphone to convert sensed sound into the second input signal.

7. The device of claim 1 wherein:

the first audio source component is a direct audio input (DAI) device to receive signals from an external source; and, the second audio source component is a microphone to convert sensed sound into the second input signal.

8. The device of claim 1 wherein:

the first audio source component is a wireless receiver to receive wireless streaming signals and generate the second input signal therefrom; and, the second audio source component is a microphone to convert sensed sound into the second input signal.

9. The device of claim 1 wherein the first and second audio source components are both microphones to convert sound into the first and second input signals, respectively.

10. A method for operating a hearing device, comprising:

producing a first input signal from a first audio source component;

producing a second input signal from a second audio source component;

measuring levels of the first and second input signals;

deriving a signal-to-noise ratio (SNR) as a ratio between the measured levels of the first and second input signals, respectively, the first input signal being regarded as signal (S) and the second input signal being regarded as noise (N);

calculating a target value $SNR_{preferred}$ for the SNR, either explicitly or by using a look-up table, as a function of the measured level of the second input signal; and, applying a gain G to the first input signal in a manner that attempts to maintain the SNR at the target value $SNR_{preferred}$; apply a gain G to the first input signal in a manner that attempts to maintain the SNR at the target value $SNR_{preferred}$ where:

$$G=SNR_{preferred}-S+N$$

and where S is the measured level of the first input signal regarded as signal and N is the measured level of the second input signal regarded as noise;

processing a combination of the first input signal and the second input signal into an output signal; and, converting the output signal into an audio output.

11. The method of claim 10 further comprising calculating the target value $SNR_{preferred}$ as a linear function of the second input signal regarded as noise.

12. The method of claim 10 further comprising calculating $SNR_{preferred}$ as:

$$SNR_{preferred}=m*N+b$$

where the slope m and intercept b are adjustable values.

13. The method of claim 10 further comprising calculating the target value $SNR_{preferred}$ as a second order polynomial function of the second input signal.

14. The method of claim 10 further comprising calculating the target value $SNR_{preferred}$ as a function of the measured level of the second input signal that decreases as the measured level of the second input signal increases.

15. The method of claim 10 wherein:

the first audio source component is a telecoil to convert a time-varying electromagnetic field sensed by the telecoil into the first input signal; and, wherein the second audio source component is a microphone to convert sensed sound into the second input signal.

16. The method of claim 10 wherein:

the first audio source component is a direct audio input (DAI) device to receive signals from an external source; and, the second audio source component is a microphone to convert sensed sound into the second input signal.

17. The method of claim 10 wherein:

the first audio source component is a wireless receiver to receive wireless streaming signals and generate the second input signal therefrom; and, the second audio source component is a microphone to convert sensed sound into the second input signal.

18. The method of claim 10 wherein the first and second audio source components are both microphones to convert sound into the first and second input signals, respectively.

* * * * *